US008997483B2

(12) United States Patent
Zahdeh et al.

(10) Patent No.: US 8,997,483 B2
(45) Date of Patent: Apr. 7, 2015

(54) ENGINE THERMAL MANAGEMENT SYSTEM AND METHOD FOR SPLIT COOLING AND INTEGRATED EXHAUST MANIFOLD APPLICATIONS

(75) Inventors: Akram R. Zahdeh, Rochester Hills, MI (US); Colin Blacklock Bosman, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 102 days.

(21) Appl. No.: 13/589,218

(22) Filed: Aug. 20, 2012

(65) Prior Publication Data

US 2013/0305708 A1 Nov. 21, 2013

Related U.S. Application Data

(60) Provisional application No. 61/649,532, filed on May 21, 2012.

(51) Int. Cl.
*F02B 29/04* (2006.01)
*F01P 3/20* (2006.01)
(Continued)

(52) U.S. Cl.
CPC ... *F01P 3/20* (2013.01); *F02F 1/36* (2013.01); *F01P 2060/08* (2013.01); *F01P 2060/02* (2013.01); *F01P 2060/16* (2013.01); *F02F 1/26* (2013.01)

(58) Field of Classification Search
CPC ..... F01P 3/20; F01P 7/165; F01P 2060/02; F01P 2060/08; F01P 2060/16; F01P 9/00; F02F 1/26; F02F 1/36; F01N 3/046
USPC ..... 60/599, 321; 123/41.72, 41.82 R, 41.29, 123/41.08–41.1, 41.44
See application file for complete search history.

(56) References Cited

U.S. PATENT DOCUMENTS 4,249,491 A * 2/1981 Stein ..... 123/142.5 R
4,369,738 A * 1/1983 Hirayama ..... 123/41.1
(Continued)

FOREIGN PATENT DOCUMENTS

DE 10301797 A1 * 7/2004 ..... F01P 7/16
DE 102008007766 A1 8/2009
(Continued)

OTHER PUBLICATIONS

DE 10301797 A1 description translation.*
(Continued)

*Primary Examiner* — Thai Ba Trieu
*Assistant Examiner* — Jason T Newton
(74) *Attorney, Agent, or Firm* — Quinn Law Group, PLLC

(57) ABSTRACT

A thermal management system and method for split cooling and integrated exhaust manifold applications in an automotive engine is provided. The thermal management system includes a cooling circuit that directs coolant through a plurality of components to warm the engine and passenger compartment efficiently, as well as remove excess heat from the engine and promote a constant operating temperature during vehicle operation. The cooling circuit directs liquid coolant, propelled by a coolant pump, through at least one of an engine block cooling jacket, an engine head cooling jacket, and an integrated exhaust manifold (IEM) cooling jacket, along a variety of cooling paths. The cooling circuit also incorporates a plurality of flow control valves to selectively distribute flow of the liquid coolant between a radiator, an engine heater core, and a return path to the coolant pump.

18 Claims, 5 Drawing Sheets

(51) Int. Cl.
*F02F 1/36* (2006.01)
*F02F 1/26* (2006.01)

(56) References Cited

U.S. PATENT DOCUMENTS

| | | | | |
|---|---|---|---|---|
| 4,539,942 | A * | 9/1985 | Kobayashi et al. | 123/41.1 |
| 4,726,324 | A * | 2/1988 | Itakura | 123/41.1 |
| 6,539,899 | B1 * | 4/2003 | Piccirilli et al. | 123/41.1 |
| 6,595,164 | B2 * | 7/2003 | Kunze et al. | 123/41.1 |
| 6,668,794 | B2 * | 12/2003 | Nagano et al. | 123/306 |
| 7,128,026 | B2 * | 10/2006 | Braun et al. | 123/41.01 |
| 7,168,398 | B2 * | 1/2007 | Ap et al. | 123/41.1 |
| 2002/0069839 | A1 * | 6/2002 | Kunze et al. | 123/41.1 |
| 2005/0028756 | A1 * | 2/2005 | Santanam et al. | 123/41.1 |
| 2008/0168956 | A1 * | 7/2008 | Lutz et al. | 123/41.1 |
| 2011/0023797 | A1 * | 2/2011 | Lenz et al. | 123/41.29 |
| 2011/0088378 | A1 * | 4/2011 | Prior et al. | 60/320 |
| 2011/0126783 | A1 * | 6/2011 | Hwang et al. | 123/41.1 |
| 2011/0197832 | A1 * | 8/2011 | Berkemeier et al. | 123/41.44 |
| 2012/0103283 | A1 * | 5/2012 | Mehring et al. | 123/41.02 |
| 2013/0186088 | A1 * | 7/2013 | Glover et al. | 60/616 |
| 2014/0261254 | A1 * | 9/2014 | Gonze et al. | 123/41.08 |

FOREIGN PATENT DOCUMENTS

| | | | | |
|---|---|---|---|---|
| FR | 2860833 | A1 | 4/2005 | |
| JP | 2007-132313 | A1 * | 5/2007 | F01P 7/16 |

OTHER PUBLICATIONS

JP 2007-132313 A1 description translation.*
DE 10301797 A1 description translation, publised on Jul. 29, 2004, entire document.*
J P 2007-132313 A1 description translation, published on May 31, 2007, entire document.*

* cited by examiner

ENGINE THERMAL MANAGEMENT SYSTEM AND METHOD FOR SPLIT COOLING AND INTEGRATED EXHAUST MANIFOLD APPLICATIONS

CROSS REFERENCE TO RELATED APPLICATIONS

This application claims the benefit of U.S. Provisional Application No. 61/649,532, filed May 21, 2012, which is hereby incorporated by reference in its entirety.

TECHNICAL FIELD

The disclosure relates to an engine thermal management system and method for split cooling and integrated exhaust manifold applications.

BACKGROUND

In a conventional thermal management system for an automotive engine, a cooling circuit circulates a coolant liquid, generally of water and antifreeze. The cooling circuit generally includes a coolant pump powered by the engine crankshaft or electronic control module. The coolant pump propels the coolant liquid through the cooling circuit. Engine thermal management systems are generally designed to promote engine and coolant liquid warm-up after cold start and promote engine cooling during normal vehicle operation.

The coolant follows a path through cooling passages in the engine block, through cooling passages in the engine head, and then directly through hoses to a radiator or heater core. At cold start, coolant is directed from the engine head through hoses to the heater core to warm the engine and passenger compartment efficiently. When the engine and passenger compartment are sufficiently warmed, a thermostat signals the change in coolant flow from heater core to radiator. Upon the signal of the thermostat, the coolant is routed from the engine head through hoses to a radiator to remove excess heat from the engine and promote a constant operating temperature during vehicle operation. The coolant liquid then travels from the radiator and/or engine heater core through a hose and back to the coolant pump.

SUMMARY

A thermal management system and method for split cooling and integrated exhaust manifold applications in an automotive engine is provided. The thermal management system includes a cooling circuit that directs coolant through a plurality of components to warm the engine and passenger compartment efficiently, as well as remove excess heat from the engine and promote a constant operating temperature during vehicle operation.

The cooling circuit directs liquid coolant, propelled by a coolant pump, through at least one of an engine block cooling jacket, an engine head cooling jacket, and an integrated exhaust manifold (IEM) cooling jacket, along a variety of cooling paths. The cooling circuit also incorporates a plurality of flow control valves to selectively distribute flow of the liquid coolant between a radiator, an engine heater core, and a return path to the coolant pump.

A thermal management method for an automotive engine during the stages of engine start, vehicle warm-up, and normal vehicle operation is also provided comprising the steps of: closing a plurality of flow control valves, after the engine is started; starting the coolant pump, when the coolant in the engine is warm; directing coolant flow from the coolant pump to at least one of an engine block cooling jacket, an engine head cooling jacket, and an IEM cooling jacket; opening at least one of the plurality of flow control valves, when the engine is warm; selectively distributing coolant flow through the plurality of flow control valves to at least one of a radiator, a heater core, and the coolant pump.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1A:
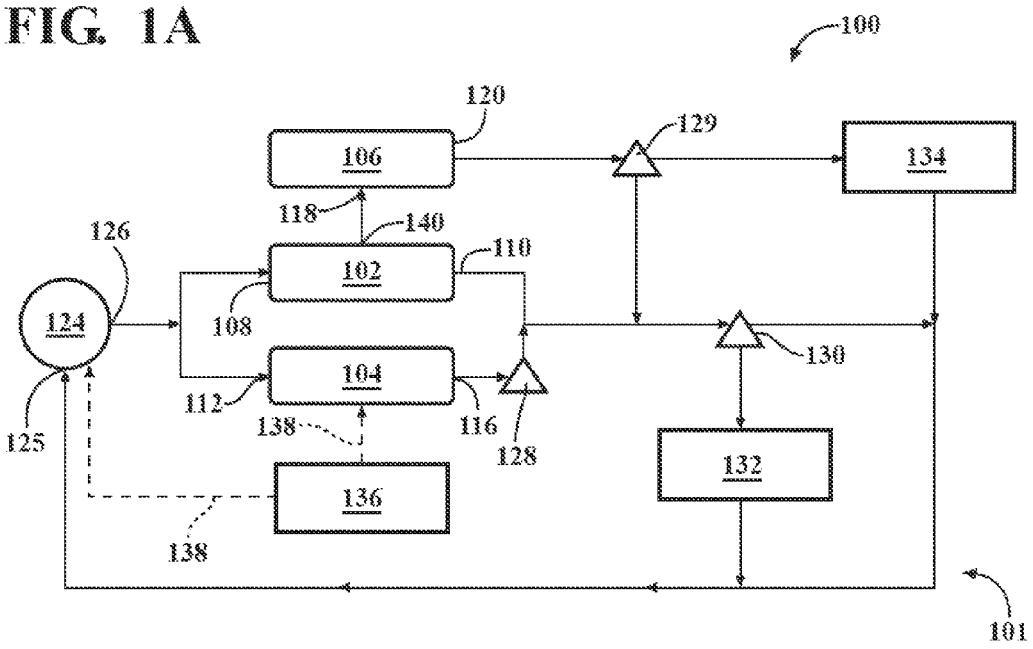
FIG. 1A is a schematic diagram of a first variation of a first example configuration of the thermal management system.

The following description and Figures refer to example embodiments and are merely illustrative in nature and not intended to limit the invention, its application, or uses. Referring to the Figures, wherein like reference numbers correspond to like or similar components throughout the several views, an engine thermal management system 100 for split cooling and integrated exhaust manifold applications is provided, and shown generally in a variety of configurations in FIGS. 1A-C, 2A-C, 3A-3C, and 4.

The engine thermal management system 100 is designed for use in integrated exhaust manifold (IEM) applications, wherein the IEM is cast directly into the engine cylinder head, rather than conventional exhaust manifold applications, wherein the exhaust manifold is a separate part attached externally to the engine cylinder head. The engine thermal management system 100 may include a cooling circuit 101 that may be configured to operate in a variety of engine types having an engine head cooling jacket 102, an engine block cooling jacket 104, an IEM cooling jacket 106, a radiator 132, a heater core 134, and a plurality of flow control valves 128, 129, 130. The engine may be a naturally aspirated engine with an integrated exhaust manifold, or any configuration of a turbo-charged engine with an IEM, for example a dual scroll turbo-charged, 4-cylinder engine with an integrated exhaust manifold.

The engine head cooling jacket 102 may include a head coolant inlet 108, head coolant passages (not shown), a plurality of transfer ports 140, and at least one head coolant outlet 110. The engine block cooling jacket 104 may include an engine block inlet 112, engine block coolant passages (not shown), and at least one engine block outlet 116. The IEM cooling jacket 106 may include an IEM inlet 118, an IEM outlet 120, and IEM coolant passages (not shown).

The cooling circuit 101 may include a coolant pump 124. The coolant pump 124 may include a coolant pump outlet 126 and a coolant pump inlet 125. The coolant pump 124 may be configured to propel the liquid coolant through the cooling circuit 101 from the coolant pump outlet 126 to at least one of the engine head inlet 108, the engine block inlet 112, and the IEM inlet 118. The coolant pump 124 may be one of an electrical, mechanical, and hybrid electrical-mechanical coolant pump 124. The mechanical pump 124 variation may be powered by the engine crankshaft (not shown) and the electrical or hybrid pump 124 may be controlled by at least one control module 136, and may provide coolant independent of engine speed and allow for stopping coolant flow, for maximum engine and/or coolant warm-up.

The cooling circuit 101 may also include a plurality of flow control valves 128, 129, 130, which may be configured to selectively distribute flow of the liquid coolant from the at least one IEM outlet 120, the at least one engine head outlet 110 and the at least one engine block outlet 116, to the radiator 132 and/or the heater core 134.

At least one control module 136 is electrically connected, with at least one electrical connection 138, to the engine and the cooling circuit 101 and may be configured to monitor and control the engine thermal management process at a variety of engine stages, such as cold start, engine warm-up, and normal vehicular operation. The control module 136 may communicate with the coolant pump 124 to control the speed at which the pump 124 operates through the at least one electrical connection 138. The control module 136 may further be configured to regulate the operation of the plurality of flow control valves. The control module 136 may also communicate with various other subsystems and sensors on the engine through the at least one electrical connection 138.

Illustrative examples of the thermal management system are shown in FIGS. 1A-C, 2A-C, 3A-C, and 4. Each of the cooling concepts depicted employs split cooling circuits for the engine block cooling jacket 104, engine head cooling jacket 102, and IEM cooling jacket 106 regions to allow for maximum coolant regulation.

Figure 1B:
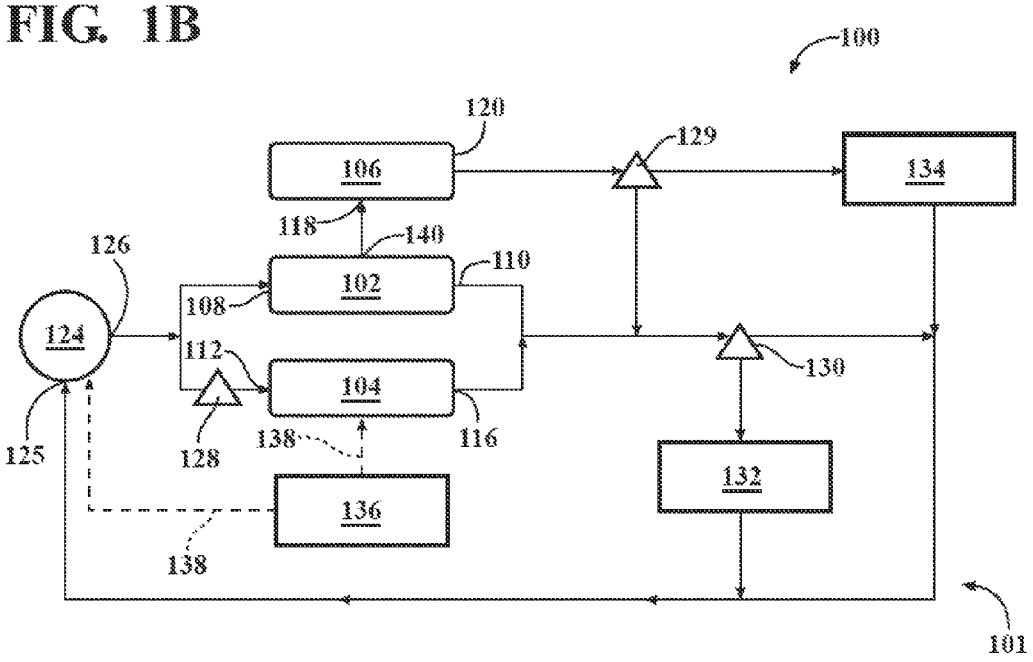
FIG. 1B is a schematic diagram of a second variation of the first example configuration of the thermal management system.
Figure 1C:
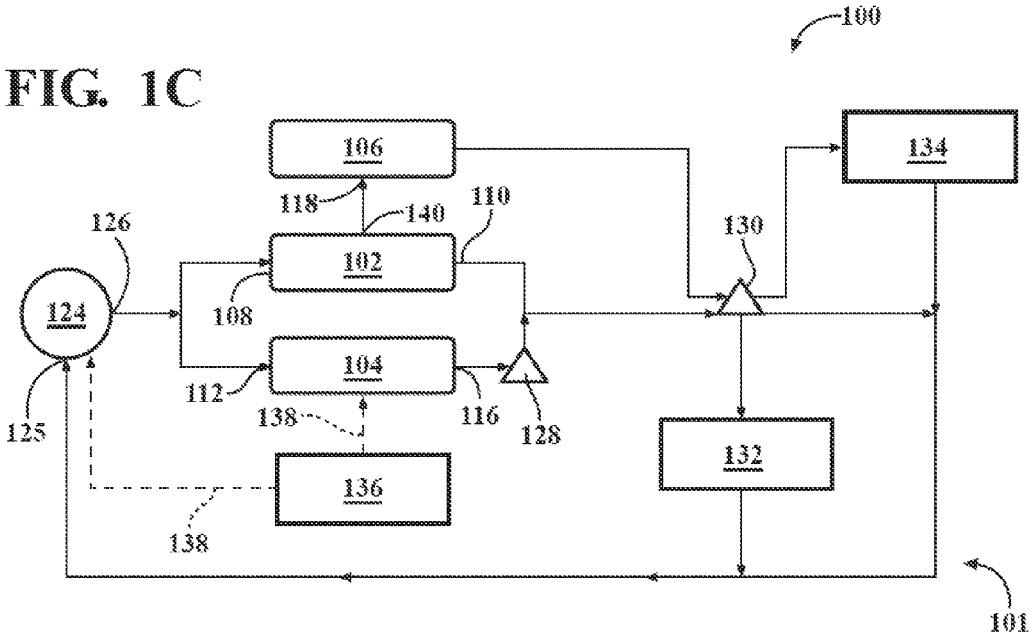
FIG. 1C is a schematic diagram of a third variation of the first example configuration of the thermal management system.

FIGS. 1A-1C depict three variations of a first example embodiment of the thermal management system 100. In the first variation of the first example embodiment, shown in FIG. 1A, the coolant pump 124 directly feeds the head cooling jacket 102 and the engine block cooling jacket 104. Coolant may be directed along a flow path to each of the engine head inlet 108 and engine block inlet 112, respectively. In this example configuration, the engine head inlet 108 and the engine block inlet 112 may be sized so as to allow the desirable amount of coolant to enter each of the respective head coolant inlet 108 and the engine block inlet 112. For example, the coolant may be distributed in a 70/30 split from the pump 124, wherein the head inlet 108 receives 70% of the coolant from the pump 124 and the engine block coolant inlet 112 receives 30% of the coolant from the pump. The coolant directed to the engine block cooling jacket 104 enters the engine block cooling jacket inlet 112 and may flow through the plurality of engine block cooling passages (not shown). The coolant may be expelled from the engine block outlet 116 to a first flow control valve 128, located on the outlet side of the engine block cooling jacket 104. The first flow control valve 128 may be any conventional, multi-port, two-way valve.

The first flow control valve 128 is shown, in FIG. 1A, on the outlet side of the engine block cooling jacket 104 and may be configured to receive coolant from the engine block cooling jacket outlet 116. The first flow control valve 128 may be further configured to adjust flow in the engine block cooling jacket 104 and regulate the engine temperature independent of the engine head cooling jacket 102 and the IEM cooling jacket 106, which can be critical for fuel spray impinging on the liner wall of the engine cylinders (not shown) within the engine block 104. The first flow control valve 128 may be further configured to selectively distribute and partially or entirely restrict flow of the liquid coolant from the engine block cooling jacket 104 to the coolant flow path of coolant expelled from the engine head cooling jacket outlet 110. The coolant may, then, be directed to a second flow control valve 130.

The coolant directed to the engine head cooling jacket 102 may enter the engine head cooling jacket 102 at the head coolant inlet 112 and may flow through the plurality of engine head cooling passages (not shown). The coolant may be expelled from the engine head outlet 110 to the second flow control valve 130. The second flow control valve 130 may be configured to receive coolant and selectively distribute and partially or entirely restrict the flow of coolant to the radiator 132 and the return path to the coolant pump 124.

The IEM cooling jacket 106 may receive coolant flow only from the head cooling jacket 102 through the plurality of transfer ports 140 to the at least one IEM inlet 118. The coolant may flow from the IEM inlet 118 through the plurality of IEM cooling passages (not shown) to the IEM outlet 120. The coolant may be directed from the IEM outlet 120 to a third flow control valve 129, which may be configured to selectively distribute and partially or entirely restrict coolant flow to one of the heater core 134 and a flow path of coolant expelled from the engine head outlet 110 and the first flow control valve 128. A minimum amount of coolant flow is constant to the heater core 134 in order to effectively raise the dew point. The coolant directed to the heater core 134 may pass through the heater core 134 and may be routed back to the coolant pump 124. The coolant directed from the third flow control valve 129 to a flow path of the coolant expelled from the engine head outlet 110 and the first control valve 128 may be directed to the second flow control valve 130. The second flow control valve may receive the coolant and selectively distribute the coolant to the radiator 132 and the coolant pump 124.

In the second variation of the first embodiment, shown in FIG. 1B, the first flow control valve 128 is shown on the inlet side of the engine block cooling jacket 104. In this variation, the first flow control valve 128 may be configured to selectively distribute and partially or entirely restrict flow of the liquid coolant from the coolant pump 124 to the engine block cooling jacket inlet 112. Coolant expelled from the engine block cooling jacket outlet 116 may be directed to the coolant flow path of coolant expelled from the engine head cooling jacket outlet 110. The coolant may then be directed to the second flow control valve 130.

In the third variation of the first example embodiment, shown in FIG. 1C, the second flow control valve 130 and the third flow control valve 129 as depicted in the FIGS. 1A and 1B, are combined as one unit, namely a second, multi-port, three-way, flow control valve 130, shown in FIG. 1C. This second, multi-port, three-way flow control valve 130 may be configured to selectively distribute and/or partially or entirely restrict coolant flow to each of the respective heater core 134, radiator 132, and coolant pump 124.

Figure 2A:
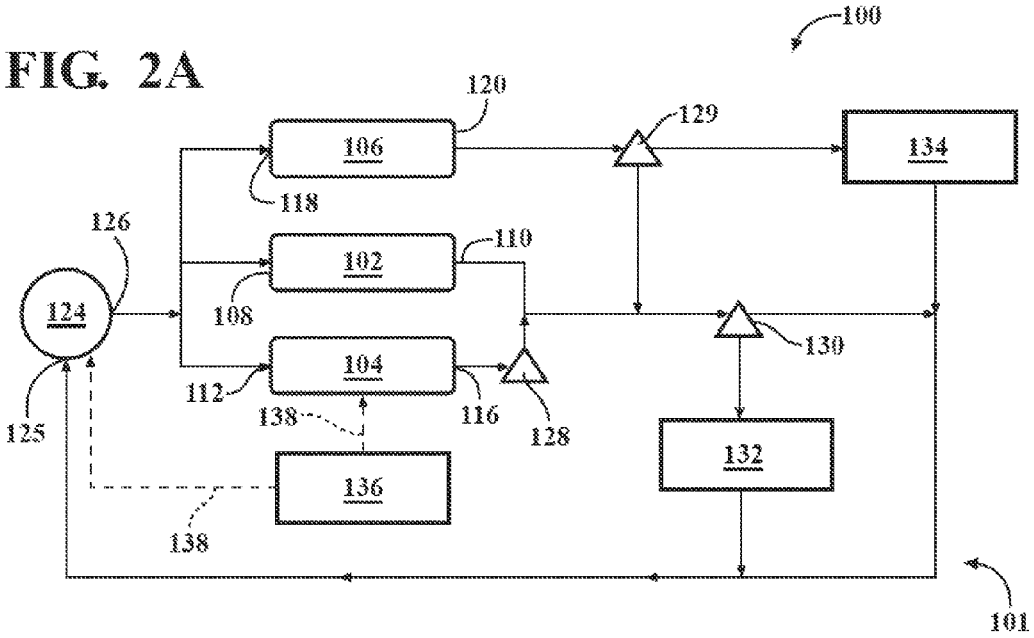
FIG. 2A is a schematic diagram of a first variation of a second example configuration of the thermal management system.
Figure 2B:
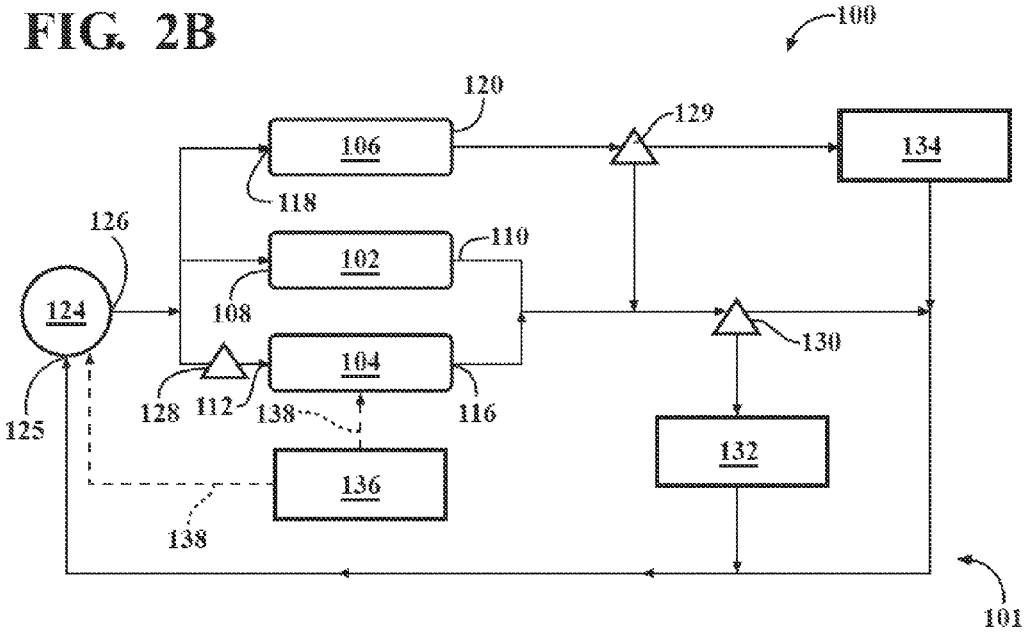
FIG. 2B is a schematic diagram of a second variation of the second example configuration of the thermal management system.
Figure 2C:
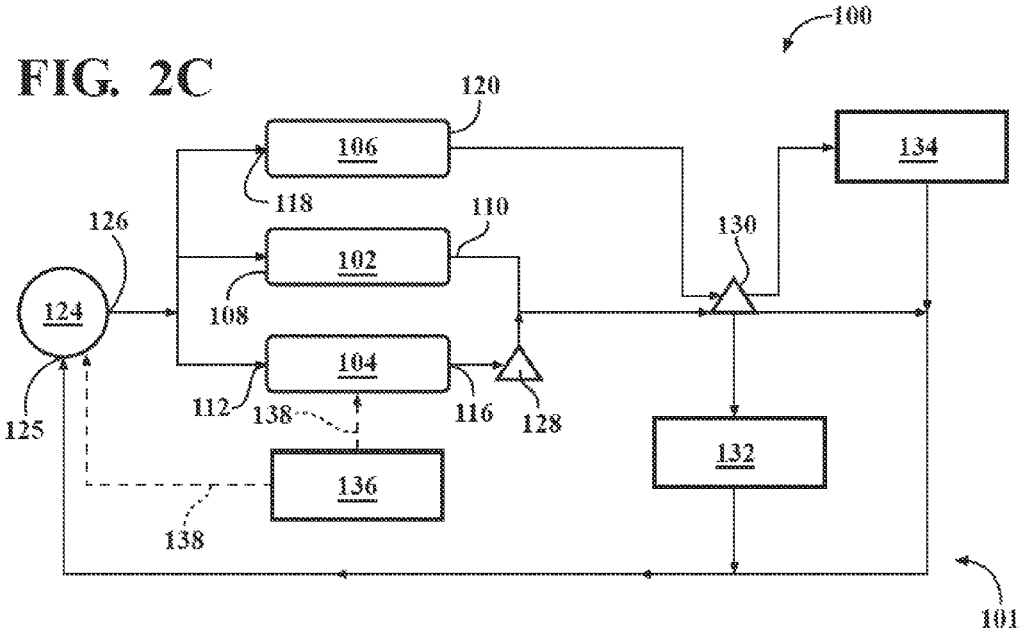
FIG. 2C is a schematic diagram of a third variation of the second example configuration of the thermal management system.

FIGS. 2A-2C depict three variations of a second example embodiment of the thermal management system 100. In the first variation of the second example embodiment, shown in FIG. 2A, the coolant pump 124 may directly feed the head cooling jacket 102, the engine block cooling jacket 104, and the IEM cooling jacket 106 as independent circuits. Coolant may be directed along a flow path to each of the head coolant inlet 108, the engine block inlet 112, and IEM inlet 118 respectively.

In the first variation of the second example embodiment, shown in FIG. 2A, the coolant directed to the engine block cooling jacket 102 may enter the engine block cooling jacket inlet 112 and flow through the plurality of engine block cooling passages (not shown). The coolant may be expelled from the engine block outlet 116 to a first flow control valve 128, located on the outlet side of the engine block cooling jacket 104. The first flow control valve 128 may be any conventional multi-port, two-way valve, which may be configured to receive coolant from the engine block cooling jacket outlet 116. The first flow control valve 128 may be further configured to adjust flow in the engine block cooling jacket 104 and regulate the engine temperature independent of the engine head cooling jacket 102 and the IEM cooling jacket 106, which can be critical for fuel spray impinging on the liner wall of the engine cylinders (not shown) within the engine block 104. The first flow control valve 128 may be further configured to selectively distribute and partially or entirely restrict flow of the liquid coolant from the engine block cooling jacket 104 to the flow path of coolant expelled from the engine head cooling jacket outlet 110.

The coolant directed to the engine head cooling jacket 102 enters the engine head cooling jacket 102 at the engine head inlet 108 and may flow through the plurality of engine head cooling passages (not shown). The coolant may be expelled from the head coolant outlet 110 to the second flow control valve 130. The second flow control valve 130 may be configured to receive coolant from the flow path of coolant expelled from the engine head cooling jacket outlet 110, the first flow control valve 128 and a third control flow control valve 129. The second flow control valve 130 may be further configured to and selectively distribute and partially or entirely restrict coolant flow to each of the radiator 132 and the flow path to the coolant pump 124.

The IEM cooling jacket 106 receives coolant flow directly from coolant pump 124 at the IEM inlet 118, as an independent circuit. The coolant may flow from the IEM inlet 118 through the plurality of IEM coolant passages (not shown) to the IEM outlet 120. The coolant flow may be directed from the IEM outlet 120 to the third flow control valve 129, which may be configured to selectively distribute and partially or entirely restrict coolant flow to the heater core 134 and the coolant flow path of coolant expelled from the engine head outlet 110 and first control valve 128. A minimum amount of coolant flow to the heater core 134 is required in order to effectively raise the dew point. The coolant directed to the heater core 134 may pass through the heater core 134 and may be routed back to the coolant pump 124. The coolant flow directed from the third flow control valve 129 to the coolant flow path of coolant expelled from the engine head outlet 110 and first flow control valve 128 may be directed to the second flow control valve 130, which may be configured to selectively distribute the coolant flow to the radiator 132 and the return path to the coolant pump 124.

In the second variation of the second embodiment, shown in FIG. 2B, the first flow control valve 128 is shown on the inlet side of the engine block cooling jacket 104. In this variation, the first flow control valve 128 may be configured to selectively distribute and partially or entirely restrict flow of the liquid coolant from the coolant pump 124 to the engine block cooling jacket inlet 112. Coolant expelled from the engine block cooling jacket outlet 116 may be directed to the coolant flow path of coolant expelled from the engine head cooling jacket outlet 110. The coolant may then be directed to the second flow control valve 130.

In the third variation of the second example embodiment, shown in FIG. 2C, the second flow control valve 130 and the third flow control valve 129, as depicted in the FIGS. 2A and 2B, are combined as one unit, namely a second, three-way, flow control valve 130, shown in FIG. 2C. This second three-way flow control valve 130 may be configured to selectively distribute and/or partially or entirely restrict coolant flow to each of the respective heater core 134, radiator 132, and the return path to the coolant pump 124.

Figure 3A:
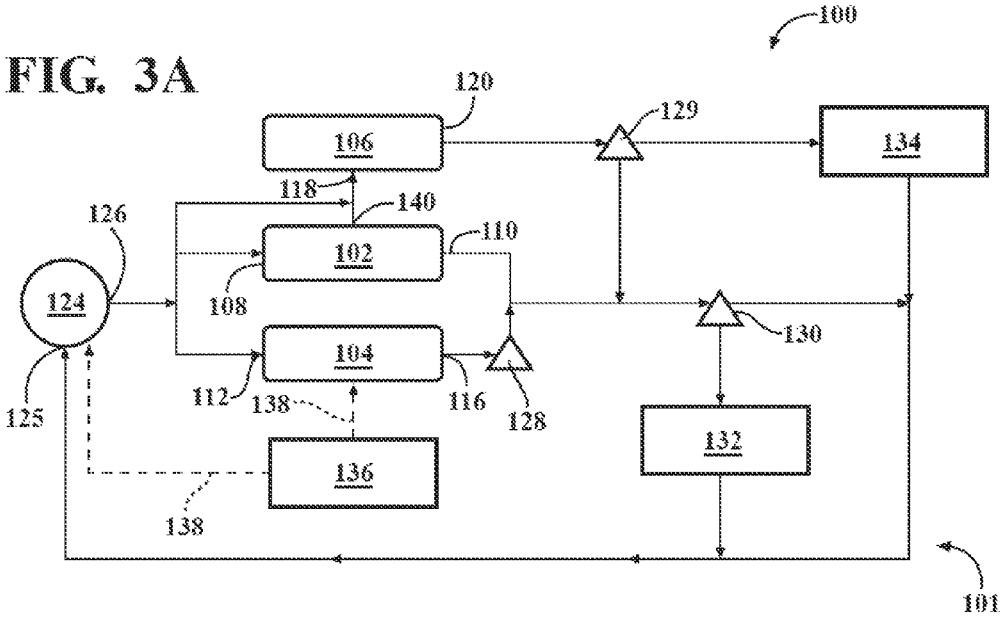
FIG. 3A is a schematic diagram of a first variation of a third example configuration of the thermal management system.
Figure 3B:
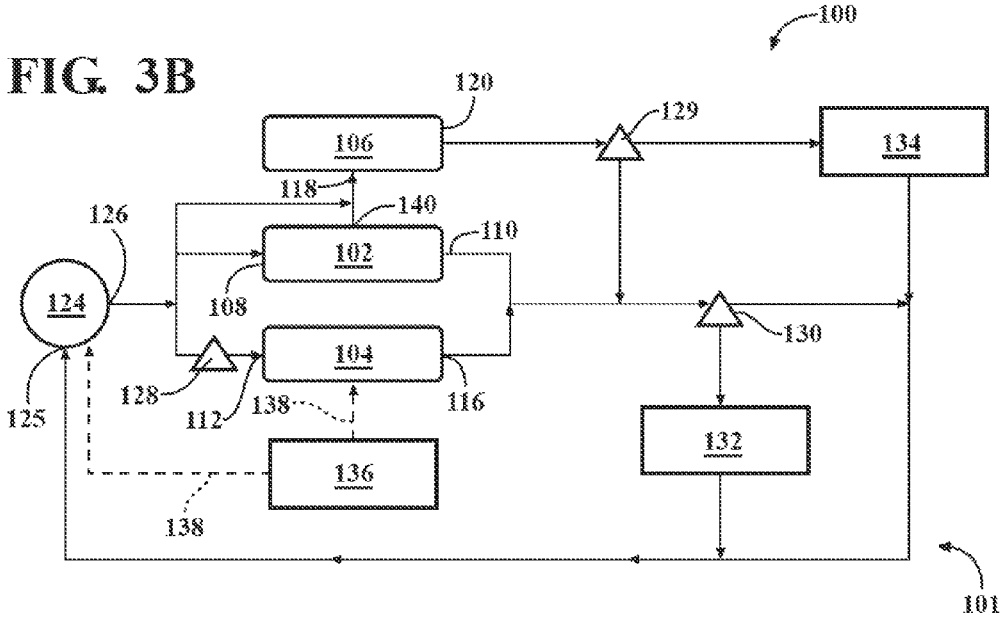
FIG. 3B is a schematic diagram of a second variation of the third example configuration of the thermal management system.
Figure 3C:
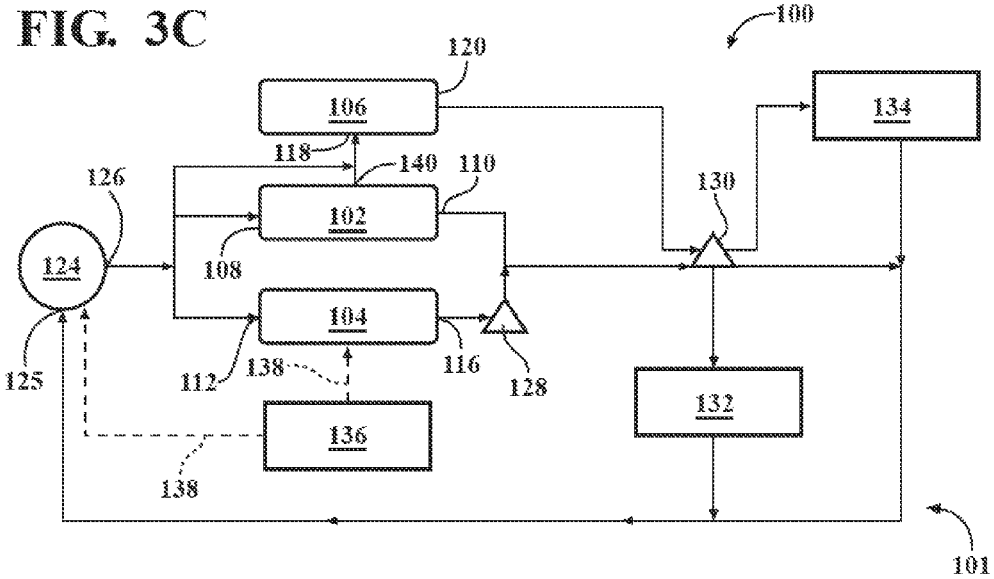
FIG. 3C is a schematic diagram of a third variation of the third example configuration of the thermal management system.

FIGS. 3A-3C depict three variations of a third example embodiment of the thermal management system 100. In the first variation of the third example embodiment, shown in FIG. 3A, the coolant pump 124 may directly feed the head cooling jacket 102 and the engine block cooling jacket 104. Coolant may be directed along a flow path to each of the head coolant inlet 108 and engine block inlet 112 respectively. In this example configuration, the head coolant inlet 108 and the engine block coolant inlet 112 may be sized so as to allow the desirable amount of coolant to enter each of the respective head coolant inlet 108 and the engine block inlet 112. For example, the coolant may be distributed in a 70/30 split from the pump 124, wherein the head inlet 108 receives 70% of the coolant from the pump 124 and the engine block coolant inlet 112 receives 30% of the coolant from the pump 124.

The coolant directed to the engine block cooling jacket 104 may enter the engine block cooling jacket inlet 112 and may flow through the plurality of engine block cooling passages (not shown). The coolant may be expelled from the engine block outlet 116 to a first flow control valve 128, located on outlet side of the engine block cooling jacket 104. The first flow control valve 128 may be any conventional multi-port, two-way valve and may be configured to receive coolant from the engine block cooling jacket outlet 116. The first flow control valve 128 may be further configured to adjust flow in the engine block cooling jacket 104 and regulate the engine temperature independent of the engine head cooling jacket 102 and the IEM cooling jacket 106, which can be critical for fuel spray impinging on the liner wall of the cylinders (not shown) within the engine block 104. The first flow control valve 128 may be further configured to selectively distribute and partially or entirely restrict flow of the liquid coolant from the engine block cooling jacket 104 to the coolant flow path of the coolant expelled from the engine head outlet 110.

The coolant directed to the engine head cooling jacket 102 may enter the engine head cooling jacket 102 at the engine head inlet 108 and may flow through the plurality of engine head cooling passages (not shown). The coolant may be expelled from the head coolant outlet 110 and forced along a flow path to the second flow control valve 130. The second flow control valve 130 may be any conventional multi-port, two-way valve and may be configured to receive coolant flow from the flow path of coolant expelled from the engine head cooling jacket outlet 110, the first flow control valve 128 and a third control flow control valve 129. The second flow control valve 130 may be further configured to selectively distribute and partially or entirely restrict coolant flow to each of the radiator 132 and the flow path to the coolant pump 124.

The IEM cooling jacket 106 may receive coolant flow from the head cooling jacket 102 and through metering from the coolant pump 124, wherein the coolant flow is directed to the coolant flow path of the coolant expelled from the engine head cooling jacket outlet 102 through the plurality of transfer ports 140. The coolant may flow from the IEM inlet 118 through the plurality of IEM coolant passages (not shown) to the IEM outlet 120. The coolant flow may be directed from the IEM outlet 120 to a third flow control valve 129, which may be configured to selectively distribute and partially or entirely restrict coolant flow to the heater core 134 and the coolant flow path of coolant expelled from the engine head outlet 110 and the first flow control valve 128. A minimum amount of coolant flow to the heater core 134 is required, in order to effectively raise the dew point. The coolant directed to the heater core 134 may pass through the heater core 134 and may then be routed back to the coolant pump 124. The coolant flow directed from the third flow control valve 129 to the coolant flow path of coolant expelled from the engine head outlet 110 and first flow control valve 128 may be directed to the second flow control valve 130. The second flow control valve 130 may be any conventional multi-port, two-way valve and may be configured to receive coolant flow from the flow path of coolant expelled from the engine head cooling jacket outlet 110, the first flow control valve 128 and a third control flow control valve 129. The second flow control valve 130 may be further configured to and selectively distribute and partially or entirely restrict coolant flow to each of the radiator 132 and the flow path to the coolant pump 124.

In the second variation of the third embodiment, shown in FIG. 3B, the first flow control valve 128 is shown on the inlet side of the engine block cooling jacket 104. In this variation the first flow control valve 128 may be configured to selectively distribute and partially or entirely restrict flow of the liquid coolant from the coolant pump 124 to the engine block cooling jacket inlet 112. Coolant expelled from the engine block cooling jacket outlet 116 may be directed to the coolant flow path of coolant expelled from the engine head cooling jacket outlet 110. The coolant may then be directed to the second flow control valve 130.

In the third variation of the third example embodiment, shown in FIG. 3C, the second flow control valve 129 and the third flow control valve 130, as depicted in the FIGS. 1A and 1B, are combined as one unit, namely a second, three-way, flow control valve 130, as shown in FIG. 1C. This second three-way flow control valve 130 may be configured to selectively distribute and/or partially or entirely restrict coolant flow to each of the respective heater core 134, radiator 132, and coolant pump 124.

Figure 4:
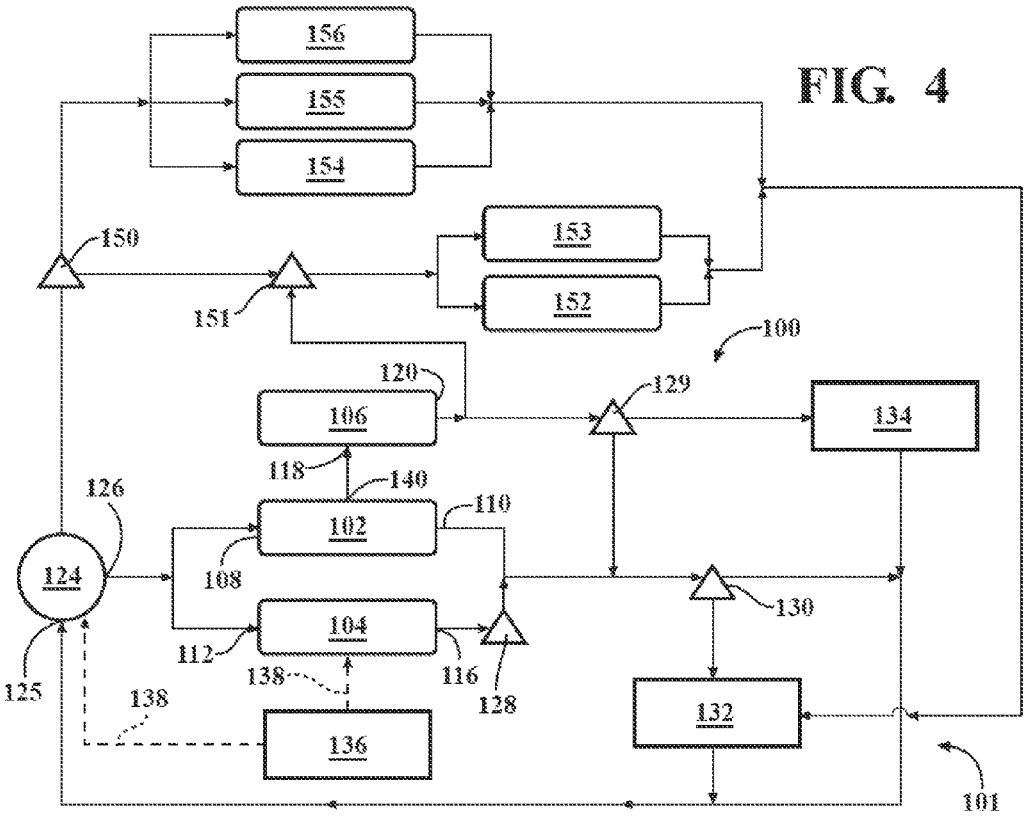
FIG. 4 is a schematic diagram of a fourth example configuration of the thermal management system.

FIG. 4 depicts a fourth example embodiment of the thermal management system 100. In the fourth example embodiment, the base cooling circuit 101 may function as shown and described with respect to FIGS. 1A-1C, 2A-2C, and 3A-3C. In the fourth example embodiment, the cooling circuit 101 may additionally include an on/off valve 150, a fourth multi-port flow control valve 151, a transmission heat exchanger 152, an engine oil heat exchanger 153, an exhaust gas recirculation (EGR) cooler 154, an intercooler 155, and a turbo-charger cooler 156, for use in turbo-charged and other similar engine configurations. As shown in FIG. 4, the pump 124 may feed coolant directly to the on/off valve 150, in addition to directly feeding at least one of the engine block cooling jacket 104, the engine head cooling jacket 102, and the IEM cooling jacket 106. The on/off valve 150 may remain closed during cold-start and engine warm-up operating modes, and may open as the load on the engine increases and cooling of each of the transmission heat exchanger 152, an engine oil heat exchanger 153, an EGR cooler 154, intercooler 155, and turbo charger cooler 156 may become necessary.

The coolant directed to each of the engine block cooling jacket 104 and the engine head cooling jacket 102 may flow along the coolant flow paths described with respect to the first, second, and third example embodiments. The coolant directed to the on/off valve 150 may be selectively distributed to each of the fourth flow control valve 151, the EGR cooler 154, the intercooler 155, and the turbo charger cooler 156. Flow directed to each of the EGR cooler 154, the intercooler 155, and the turbo charger cooler 156 may pass through the each of the respective components to promote cooling. The coolant may then be directed to the radiator 132 and back to the coolant pump 124.

The on/off valve 150 may also direct coolant to a fourth flow control valve 151, which may be a valve having two input ports and two output ports. The fourth flow control valve 151 may, additionally, receive coolant flow expelled from the IEM outlet 120. The fourth flow control valve may selectively distribute coolant flow to each of the transmission heat exchanger 152 and the engine oil heat exchanger 153. Flow directed to the transmission heat exchanger 152 and the engine oil heat exchanger 153 may flow through each of the components 152, 153 respectively and may flow through the radiator 132, and may be directed back to the coolant pump 124.

In each variation of each configuration it is critical that coolant flow directed to the heater core 134, through the third flow control valve 129, is not mixed with the coolant flow expelled from the engine head cooling jacket 102 and engine block cooling jacket 104, to preserve the useful heat to warm both the passenger compartment, the engine, and the coolant itself.

Each of the configurations function differently in differing automotive operational modes, in order to strategically distribute coolant efficiently in each operating mode such as: engine cold-start, cold weather warm-up, warm weather warm-up, and engine cooling, during normal vehicle operation.

During engine cold-start operating mode, in each of the three configurations shown in FIGS. 1A, 2A, and 3A, each of the respective first, second, and third flow control valves 128, 129, 130 are fully closed, and the pump 124 is initially turned off, rendering the coolant stagnant. As shown in FIG. 4, the on/off valve 150 may be fixed fully closed. The primary objective of the thermal management system and cooling circuit, during engine cold-start, is to warm the engine and the coolant to a desired temperature for vehicle operation.

During a cold weather warm-up operational mode, once the coolant has sufficiently warmed during the engine cold-start operating mode, the coolant can be used to feed the heater core 134 and warm the passenger cabin of the vehicle as needed. During cold weather warm-up, the coolant pump 124 may be turned-on, and the pump 124 speed may be regulated by the at least one control module 136 in order to continue warming the engine, while also feeding the heater core 134 to warm the passenger compartment. The coolant flow path within the cooling circuit 101 during cold weather warm-up is dictated by the configuration of the cooling circuit 101. In all configurations, during cold weather warm-up, each of the respective first and second flow control valves 128, 130 may be fully closed, and the third flow control valve 129 may be fixed fully open.

In the first configuration shown, by example, in FIG. 1A, the coolant pump 124 may feed coolant directly to both the engine block cooling jacket 104 and the engine head cooling jacket 102. The engine block inlet 112 and the engine head inlet 108 may be fixed open, during cold weather warm-up. However, because the first flow control valve 128 may be fully closed, the coolant in the engine block jacket remains stagnant to facilitate engine warm-up. The second flow control valve 130 may also be fully closed, thereby routing all flow from the engine head cooling jacket 102 to the IEM cooling jacket 106. The third flow control valve 129 may be configured to receive all flow from the IEM cooling jacket 106. The third flow control valve 129 may be fully opened, during cold weather warm-up, receiving all flow generated by the coolant pump 124 and transmitting the coolant flow received to the heater core 134, to maximize the efficiency of warming the vehicle passenger compartment.

In the second configuration, shown by example in FIG. 2A, the coolant pump 124 may feed coolant directly to each of the respective IEM cooling jacket 106, the engine block cooling jacket 104, and the engine head cooling jacket 102. The engine block inlet 112, the engine head inlet 108, and the IEM inlet 118 may be fixed open, during cold weather warm-up. However, because the first flow control valve 128 and second flow control valve 130 are fully closed and the coolant routed to each of the engine block jacket 102 and the engine head jacket 102 remains stagnant to facilitate engine warm-up. All flow may be routed directly from the pump 124 to the IEM cooling jacket 106. The third flow control valve 129 may be configured to receive all flow from the IEM cooling jacket 106. The third flow control valve 129 may be fully opened, during cold weather warm-up, and may receive all flow generated by the coolant pump 124 and may further transmit the coolant flow received to the heater core 134, to maximize the efficiency of warming the vehicle passenger compartment.

In the third configuration shown, by example, in FIG. 3A, the coolant pump 124 may feed coolant directly to both the engine block cooling jacket 104 and the engine head cooling jacket 102. The engine block inlet 112 and the engine head inlet 108 may be fixed open, during cold weather warm-up. However, because the first flow control valve 128 may be fully closed the coolant in the engine block jacket 104 remains stagnant to facilitate engine warm-up. The second flow control valve 130 may also be fully closed, thereby forcing all coolant flow from the engine head cooling jacket 102 to the IEM cooling jacket 106 through the plurality of transfer ports 140. The IEM cooling jacket 106, additionally, may receive coolant flow through metering from the coolant pump 124, wherein the coolant flow may be directed to the coolant flow path of the coolant expelled from the engine head cooling jacket 102 through the plurality of transfer ports 140. The third flow control valve 129 may be configured to receive all flow from the IEM cooling jacket 106. The third flow control valve 129 may be fully opened, during cold weather warm-up, and may be configured to receive all flow generated by the coolant pump 124 and may transmit the coolant received to the heater core 134, to maximize the efficiency of warming the vehicle passenger compartment.

With respect to each of the respective first, second, and third configurations, during cold weather warm-up, as shown in FIG. 4, the on/off valve 150 may be fixed fully closed. The fourth flow control valve 151 may be configured to receive warm water coolant flow from the IEM outlet 120 and further configured to direct warm water coolant flow to each of the engine oil heat exchanger 153 and the transmission heat exchanger 152, to promote warming of each of the respective components.

During a warm weather warm-up operating mode, once the coolant has sufficiently warmed during the engine cold-start operating mode, the coolant can be used to continue to warm the engine, as heat to the passenger compartment is not needed due to the warm or mild ambient temperature. During warm weather warm-up the coolant pump 124 may be turned-on, and the pump 124 speed may be regulated by the at least one control module 136 in order to continue warming the engine. The coolant flow path within the cooling circuit 101 during warm weather warm-up is dictated by the configuration of the cooling circuit 101. In all configurations, during warm weather warm-up, each of the respective first, second, and third flow control valves 128, 129, 130 may be fixed open and may be configured to selectively distribute coolant throughout the cooling circuit 101.

In the first configuration shown, by example, in FIG. 1A, the coolant pump 124 may feed coolant directly to both the engine block cooling jacket 104 and the engine head cooling jacket 102. The engine block inlet 112 and the engine head inlet 108 may be fixed open, during warm weather warm-up. Flow directed through the engine block cooling jacket 104 may be routed to the first flow control valve 128 which may be fixed fully open and route flow to the second flow control valve 130. The flow directed through the engine head cooling jacket 102 may be selectively distributed between the IEM cooling jacket 106 and the second control valve 130.

The flow routed from the engine head cooling jacket 102 to the IEM cooling jacket 106 may be routed to the third flow control valve 129, which may be fixed open. The third flow control valve 129 may selectively distribute nearly all the coolant, which may pass through the third flow control valve 129, back to the flow path of the coolant expelled from the engine head cooling jacket outlet 110 and the first flow control valve 128. Only the leakage path of the third flow control valve 129 is open to the heater core, allowing only the minimum amount of flow necessary to raise the dew point to be selectively distributed to the heater core 134. The second flow control valve 130 may then receive the flow from the third flow control valve 129, the engine head cooling jacket 102, and the first flow control valve 128 and selectively distribute all flow received back to the coolant pump 124. The engine may still be in the warm-up phase and need not be cooled during warm weather warm-up. Therefore, no coolant is selectively distributed to the radiator 132 by the second flow control valve 130, until normal vehicle operating mode or engine cooling mode is reached.

In the second configuration shown, by example, in FIG. 2A, the coolant pump 124 may feed coolant directly to each of the respective IEM cooling jacket 106, the engine block cooling jacket 104, and the engine head cooling jacket 102. The engine block inlet 112, the engine head inlet 108, and the IEM inlet 118 may be fixed open, during warm weather warm-up. Flow directed through the engine block cooling jacket 104 is routed to the first flow control valve 128, which may be fixed to be fully open and may route coolant flow to the second flow control valve 130. The flow directed through the engine head cooling jacket 102 may be routed to the second control valve 130. The flow directed to the IEM cooling jacket 106 may be routed to the third flow control valve 129, which may be fixed open. The third flow control valve may selectively distribute nearly all the coolant back to the flow path of the coolant expelled from the engine head cooling jacket outlet 110 and the first flow control valve 128. Only the leakage path of the third flow control valve 129 may be open to the heater core 134, allowing only the minimum amount of flow necessary to raise the dew point to be selectively distributed to the heater core 134.

The second flow control valve 130 may receive the flow from the third flow control valve 129, the engine head cooling jacket 102, and the first flow control valve 128 and selectively distribute all flow received back to the coolant pump 124. The engine may still be in the warm-up phase and need not be cooled during warm weather warm-up. Therefore, no coolant is selectively distributed to the radiator 132, until normal vehicle operation or engine cooling mode is reached.

In the third configuration shown, by example, in FIG. 3A, the coolant pump 124 may feed coolant directly to both the engine block cooling jacket 104 and the engine head cooling jacket 102. The engine block inlet 112 and the engine head inlet 108 are fixed open, during warm weather warm-up. Flow directed through the engine block cooling jacket 104 may be routed to the first flow control valve 128 which may be fixed to be fully open and route flow to the second flow control valve 130. The flow directed through the engine head cooling jacket 102 may be selectively distributed to each of the respective IEM cooling jacket 106 and the second control valve 130. The IEM cooling jacket 106 may, additionally, receive coolant flow through metering from the coolant pump 124, wherein the coolant flow may be directed to the coolant flow path of the coolant expelled from the engine head cooling jacket 102 through the plurality of transfer ports 140. The third flow control valve 129 may be configured to receive all flow from the IEM cooling jacket 106. Only the leakage path of the third flow control valve 129 may be open to the heater core 134, allowing only the minimum amount of flow necessary to raise the dew point to be selectively distributed to the heater core 134. The remaining flow not distributed to the heater core 134, may be directed back to the flow path of the coolant expelled from the head cooling jacket outlet 110 and the first flow control valve 128. The second flow control valve 130 may receive the flow from the third flow control valve 129, the engine head cooling jacket 102, and the first flow control valve 128 and may selectively distribute all flow received back to the return flow path to the coolant pump 124. The engine is still in the warm-up phase and need not be cooled during warm weather warm-up. Therefore, no coolant is selectively distributed to the radiator 132, from the second flow control valve 130 until normal vehicle operation or engine cooling mode is reached.

With respect to each of the respective first, second, and third configurations, during warm weather warm-up, as shown in FIG. 4, the on/off valve 150 may be fixed fully closed. The fourth flow control valve 151 may be configured to receive warm water coolant flow from the IEM outlet 120 and further configured to direct warm water coolant flow to each of the engine oil heat exchanger 153 and the transmission heat exchanger 152, to promote warming of each of the respective components.

During a normal vehicle operation and engine cooling mode, the objective of the thermal management system is to route as much coolant flow through the radiator as possible. Further, in engine cooling mod and during normal vehicle operating mode, the coolant pump 124 may be turned on and may be regulated by the at least one control module 136, as well as coupled to the accessory drive shaft (not shown) for high speed, maximum flow. At low speed, the pump 124 may be configured to be operated by the at least one control module 136 alone, and at maximum speed, to generate peak coolant flow, under high load conditions. The coolant flow path within the cooling circuit 101, during normal vehicle operation and engine cooling mode is dictated by the configuration of the cooling circuit 101. In all configurations, during engine cooling, each of the respective first, second, and third flow control valves 128, 129, 130 are open and may be configured to selectively distribute coolant throughout the cooling circuit 101.

In the first configuration shown, by example, in FIG. 1A, the coolant pump 124 may feed coolant directly to both the engine block cooling jacket 104 and the engine head cooling jacket 102. The engine block inlet 112 and the engine head inlet 108 may be fixed open, during engine cooling operation. Flow directed through the engine block cooling jacket 104 may be routed to the first flow control valve 128 which is fixed to be fully open and route flow to the second flow control valve 130. The first control valve 128 may be dynamically adjusted to restrict flow through the engine block cooling jacket 104, as necessary, to maintain the liner temperature of the engine cylinders (not shown), to promote impinging fuel evaporation and minimize the possibility of pre-ignition.

The flow directed through the engine head cooling jacket 102 may be selectively distributed to the IEM cooling jacket 106 and the second control valve 130. The flow routed from the engine head cooling jacket 102 to the IEM cooling jacket 106 may be routed to the third flow control valve 129, which may be fixed open. The third flow control valve may selectively distribute nearly all the coolant received, back to the flow path of the coolant expelled from the engine head cooling jacket outlet 110 and the first flow control valve 128. Only the leakage path of the third flow control valve 129 may be open to the heater core, allowing only the minimum amount of flow necessary to raise the dew point. The second flow control valve 130 may receive the flow from the third flow control valve 129, the engine head cooling jacket 102, and the first flow control valve 128 and may selectively distribute flow to the radiator 132 and the coolant pump 124.

In the second configuration shown, by example, in FIG. 2A, the coolant pump 124 may feed coolant directly to each of the respective IEM cooling jacket 106, the engine block cooling jacket 104, and the engine head cooling jacket 102. The engine block inlet 112, the engine head inlet 108, and the IEM inlet 118 may be fixed open, during engine cooling operation. Flow directed through the engine block cooling jacket 104 may be routed to the first flow control valve 128, which may be fixed to be fully open and route flow to the second flow control valve 130. The first control valve 128 may be dynamically adjusted to restrict flow through the engine block cooling jacket 104, as necessary, to maintain the liner temperature of the engine cylinders (not shown), to promote impinging fuel evaporation and minimize the possibility of pre-ignition.

The flow directed through the engine head cooling jacket 102 may be routed to the second control valve 130. The flow directed to the IEM cooling jacket 106 may be routed to the third flow control valve 129, which may be fixed open. The third flow control valve may selectively distribute nearly all the coolant received back, to the flow path of the coolant expelled from the engine head cooling jacket outlet 110 and the first flow control valve 128. Only the leakage path of the third flow control valve 129 may be open to the heater core 134, allowing only the minimum amount of flow necessary, to raise the dew point, to be selectively distributed to the heater core 134. The second flow control valve 130 may receive the flow from the third flow control valve 129, the engine head cooling jacket 102, and the first flow control valve 128 and selectively distribute flow received to the radiator 132 and the coolant pump 124.

In the third configuration shown, by example, in FIG. 3A, the coolant pump 124 may feed coolant directly to both the engine block cooling jacket 104 and the engine head cooling jacket 102. The engine block inlet 112 and the engine head inlet 108 may be fixed open, during engine cooling. Flow directed through the engine block cooling jacket 104 may be routed to the first flow control valve 128 which may be fixed to be fully open and route flow to the second flow control valve 130. The first control valve 128 may be dynamically adjusted to restrict flow through the engine block cooling jacket 104, as necessary, to maintain the liner temperature of the engine cylinders (not shown), to promote impinging fuel evaporation and minimize the possibility of pre-ignition.

The flow directed through the engine head cooling jacket 102 may be selectively distributed to each of the respective IEM cooling jacket 106 and the second control valve 130. The IEM cooling jacket 106 may, additionally, receive coolant flow through metering from the coolant pump 124, wherein the coolant flow may be directed to the coolant flow path of the coolant expelled from the engine head cooling jacket 102 through the plurality of transfer ports 140. The third flow control valve 129 may be configured to receive all flow from the IEM cooling jacket 106. Only the leakage path of the third flow control valve 129 is open to the heater core, allowing only the minimum amount of flow necessary to raise the dew point to be selectively distributed to the heater core 134. The remaining flow received by the third flow control valve 129, not distributed to the heater core 134, may be directed back to the flow path of the coolant expelled from the head cooling jacket outlet 110 and the first flow control valve 128. The second flow control valve 130 may receive the flow from the third flow control valve 129, the engine head cooling jacket 102, and the first flow control valve 128 and may selectively distribute flow received to the radiator 132 and coolant pump 124.

With respect to each of the respective first, second, and third configurations, during normal vehicle operation and engine cooling, as shown in FIG. 4, the on/off valve 150 may be fixed open, to direct cold water coolant flow to each of the respective fourth flow control valve 151, the EGR cooler 154, the intercooler 155, and the turbo charger cooler 156. The fourth flow control valve 151 may receive cold water coolant flow from the on/off valve 150 and the IEM cooling jacket outlet 120. The fourth flow control valve 151 may be configured to direct cold water coolant flow to each of the respective engine oil heat exchanger 153 and the transmission heat exchanger 152.

A thermal management method for an automotive engine during the stages of engine start, vehicle warm-up, and normal vehicle operation is also provided comprising the steps of: closing a plurality of flow control valves 128, 129, 130, after the engine is started; starting the coolant pump 124, when the coolant in the engine is warm; directing coolant flow from the coolant pump 124 to at least one of an engine block cooling jacket 104, an engine head cooling jacket 102, and an IEM cooling jacket 106; opening at least one of the plurality of flow control valves 128, 129, 130, when the engine is warm; selectively distributing coolant flow through the plurality of flow control valves 128, 129, 130 to at least one of a radiator 132, a heater core 134, and the coolant pump 124.

A thermal management method for an automotive engine during the stages of engine start, vehicle warm-up, and normal vehicle operation additionally comprising the steps of: selectively distributing coolant from an on/off valve 150 to one of the plurality of flow control valves 128, 129, 130, 151, an exhaust gas recirculation cooler 154, an intercooler 155, and a turbo charger cooler 156, when engine load is increased and cooling of the exhaust gas recirculation cooler 154, the intercooler 155, and the turbo charger cooler 156 is needed; selectively distributing coolant from the fourth flow control valve 151 to a transmission heat exchanger 152, an engine oil heat exchanger 153, when engine load is increased and cooling of the transmission heat exchanger 152 and engine oil heat exchanger 153 is needed; and distributing coolant from the transmission heat exchanger 152, the engine oil heat exchanger 153, the exhaust gas recirculation cooler 154, the intercooler 155, and the turbocharger cooler 156 to a radiator 132 to cool the engine.

Since the engine temperature can be more precisely efficiently controlled with the thermal management system 100, the system 100 can operate, in a variety of configurations in engines with integrated exhaust manifolds, to minimize engine warm-up time to facilitate decreased friction and improved fuel economy; minimize the warm-up time of the passenger compartment to improve passenger comfort; and effectively manage the liner temperature of the engine cylinders to minimize auto-ignition and soot formation.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. An engine thermal management system for split cooling and integrated exhaust manifold applications, the system comprising:

a coolant pump;

an engine block cooling jacket and an engine head cooling jacket, each configured to receive coolant directly from the coolant pump;

an IEM cooling jacket configured to receive coolant directly from at least one of the coolant pump and the engine head cooling jacket;

a first plurality of multi-port flow control valves configured to receive coolant from each of the engine block cooling jacket, the engine head cooling jacket, and the IEM cooling jacket, the first plurality of multi-port flow control valves including a first flow control valve and a second flow control valve, such that the first flow control valve receives coolant from the engine block cooling jacket and the second flow control valve receives coolant from each of the engine block cooling jacket, the engine head cooling jacket, and the IEM cooling jacket, wherein coolant flows through each one of the first plurality of multi-port flow control valves independently of each of the other ones of the first plurality of multi-port flow control valves;

a heater core configured to receive coolant from at least one of the first plurality of multi-port flow control valves;

a radiator configured to receive coolant from at least one of the first plurality of multi-port flow control valves;

at least one control module configured to regulate the coolant pump and actuate the first plurality of multi-port flow control valves; and wherein the coolant pump is configured to receive coolant from each of the radiator, the heater core, and at least one of the first plurality of multi-port flow control valves.

2. The engine thermal management system of claim 1 wherein the engine head cooling jacket and the engine block cooling jacket receive coolant directly from the coolant pump and the IEM cooling jacket receives coolant directly from the engine head cooling jacket.

3. The engine thermal management system of claim 2 wherein the second flow control valve is configured to receive coolant from at least one of the engine block cooling jacket via the first flow control valve, the engine head cooling jacket, and the IEM cooling jacket, the second flow control valve further configured to transmit coolant to at least one of the radiator, the heater core, and the coolant pump.

4. The engine thermal management system of claim 2 wherein the first plurality of multi-port flow control valves further includes a third flow control valve, such that:

the first flow control valve is configured to receive coolant from the engine block cooling jacket and further configured to occupy a closed position and a first open position, such that the first flow control valve expels coolant to the second flow control valve when occupying the first open position;

the second flow control valve is configured to receive coolant from at least one of the engine block cooling jacket via the first flow control valve, the engine head cooling jacket, and the IEM cooling jacket via the third flow control valve, the second flow control valve further configured to occupy a closed position, a first open position, and a second open position, such that the second flow control valve expels coolant to the coolant pump when occupying the first open position and expels coolant to the radiator when occupying the second open position; and the third flow control valve is configured to receive coolant from the IEM cooling jacket the third flow control valve further configured to occupy a closed position, a first open position, and a second open position, such that the third flow control valve expels coolant to the heater core when occupying the first open position and expels coolant to the second flow control valve when occupying the second open position.

5. The engine thermal management system of claim 4 wherein the system further comprises:

a second plurality of flow control valves, including at least one on/off valve and a fourth multiport flow control valve, the on/off valve configured to receive coolant from the coolant pump, the fourth multi-port flow control valve configured to receive coolant from at least one of the IEM cooling jacket outlet and the on/off valve;

a transmission heat exchanger configured to receive coolant from the fourth multi-port flow control valve and expel coolant to the radiator;

an engine oil heat exchanger configured to receive coolant from the fourth multi-port flow control valve and expel coolant to the radiator;

an exhaust gas recirculation cooler configured to receive coolant from the on/off valve and configured to expel coolant to the radiator;

an intercooler configured to receive coolant from the on/off valve and configured to expel coolant to the radiator;

a turbocharger cooler configured to receive coolant from the on/off valve and configured to expel coolant to the radiator; and wherein the on/off valve is configured to expel coolant to one of the fourth multi-port flow control valve, the exhaust gas recirculation cooler, the intercooler, and the turbo charger cooler.

6. The engine thermal management system of claim 1 wherein the engine head cooling jacket, the engine block cooling jacket, and the IEM cooling jacket receive coolant directly from the coolant pump as independent circuits.

7. The engine thermal management system of claim 6 wherein the second flow control valve is configured to receive coolant from at least one of the engine block cooling jacket via the first flow control valve, the engine head cooling jacket, and the IEM cooling jacket, the second flow control valve further configured to transmit coolant to at least one of the radiator, the heater core, and the coolant pump.

8. The engine thermal management system of claim 6 wherein the first plurality of multi-port flow control valves further includes a third flow control valve, such that:

the first flow control valve is configured to receive coolant from the engine block cooling jacket and further configured to occupy a closed position and a first open position, such that the first flow control valve expels coolant to the second control valve when occupying the first open position;

the second flow control valve is configured to receive coolant from at least one of the engine block cooling jacket via the first flow control valve, the engine head cooling jacket, and the IEM cooling jacket via the third flow control valve, the second flow control valve further configured to occupy a closed position, a first open position, and a second open position, such that the second flow control valve expels coolant to the coolant pump when occupying the first open position and expels coolant to the radiator when occupying the second open position; and the third flow control valve is configured to receive coolant from the IEM cooling jacket the third flow control valve further configured to occupy a closed position, a first open position, and a second open position, such that the third flow control valve expels coolant to the heater core when occupying the first open position and expels coolant to the second flow control valve when occupying the second open position.

9. The engine thermal management system of claim 8 wherein the system further comprises:

a second plurality of flow control valves, including at least one on/off valve and a fourth multi-port flow control valve, the on/off valve configured to receive coolant from the coolant pump, the fourth multi-port flow control valve configured to receive coolant from at least one of the IEM cooling jacket outlet and the on/off valve;

a transmission heat exchanger configured to receive coolant from the fourth multi-port flow control valve and expel coolant to the radiator;

an engine oil heat exchanger configured to receive coolant from the fourth multi-port flow control valve and expel coolant to the radiator;

an exhaust gas recirculation cooler configured to receive coolant form the on/off valve and configured to expel coolant to the radiator;

an intercooler configured to receive coolant from the on/off valve and configured to expel coolant to the radiator;

a turbocharger cooler configured to receive coolant from the on/off valve and configured to expel coolant to the radiator; and wherein the on/off valve is configured to expel coolant to one of the fourth multi-port flow control valve, the exhaust gas recirculation cooler, the intercooler, and the turbocharger cooler.

10. The engine thermal management system of claim 1 wherein the engine head cooling jacket and the engine block cooling jacket receives coolant directly from the coolant pump, and the IEM cooling jacket receives coolant from the engine head cooling jacket and through metering of the coolant received by the engine head cooling jacket from the coolant pump.

11. The engine thermal management system of claim 10 wherein the second flow control valve is configured to receive coolant from at least one of the engine block cooling jacket via the first flow control valve, the engine head cooling jacket, and the IEM cooling jacket, the second flow control valve further configured to transmit coolant to at least one of the radiator, the heater core, and the coolant pump.

12. The engine thermal management system of claim 10 wherein the first plurality of multi-port flow control valves further includes a third flow control valve, such that:

the first flow control valve is configured to receive coolant from the engine block cooling jacket and further configured to occupy a closed position and a first open position, such that the first flow control valve expels coolant to the second control valve when occupying the first open position;

the second flow control valve is configured to receive coolant from at least one of the engine block cooling jacket via the first flow control valve, the engine head cooling jacket, and the IEM cooling jacket via the third flow control valve, the second flow control valve further configured to occupy a closed position, a first open position, and a second open position, such that the second flow control valve expels coolant to the coolant pump when occupying the first open position and expels coolant to the radiator when occupying the second open position; and the third flow control valve is configured to receive coolant from the IEM cooling jacket the third flow control valve further configured to to occupy a closed position, a first open position, and a second open position, such that the third flow control valve expels coolant to the heater core when occupying the first open position and expels coolant to the second flow control valve when occupying the second open position.

13. The engine thermal management system of claim 12 wherein the system further comprises:

a second plurality of flow control valves, including at least one on/off valve and a fourth multiport flow control valve, the on/off valve configured to receive coolant from the coolant pump, the fourth multi-port flow control valve configured to receive coolant from at least one of the IEM cooling jacket outlet and the on/off valve;

a transmission heat exchanger configured to receive coolant from the fourth multi-port flow control valve and expel coolant to the radiator;

an engine oil heat exchanger configured to receive coolant from the fourth multi-port flow control valve and expel coolant to the radiator;

an exhaust gas recirculation cooler configured to receive coolant from the on/off valve and configured to expel coolant to the radiator;

an intercooler configured to receive coolant from the on/off valve and configured to expel coolant to the radiator;

a turbocharger cooler configured to receive coolant from the on/off valve and configured to expel coolant to the radiator; and wherein the on/off valve is configured to expel coolant to one of the fourth multi-port flow control valve, the exhaust gas recirculation cooler, the intercooler, and the turbocharger cooler.

14. A method of thermal management for an automotive engine comprising the steps of:

actuating, via at least one control module, a plurality of flow control valves to occupy a closed position after the engine is started;

signaling, via the at least one control module, a coolant pump to circulate a coolant, when the coolant in the engine reaches a predetermined temperature;

selectively directing, via the at least one control module, coolant flow from the coolant pump to each of an engine block cooling jacket, an engine head cooling jacket, and an Integrated Exhaust Manifold cooling jacket;

actuating, via the at least one control module, at least one of the first plurality of flow control valves to occupy an open position, when the engine reaches a predetermined temperature; and selectively distributing, via the at least one control module, coolant flow through the first plurality of flow control valves to at least one of a radiator, a heater core, and the coolant pump, wherein coolant flows through each one of the plurality of flow control valves independently of each of the other ones of the plurality of flow control valves.

15. The method of claim 14 wherein the plurality of flow control valves includes:

a first flow control valve configured to receive coolant from the engine block cooling jacket and further configured to occupy a closed position and a first open position, such that in the first open position the first flow control valve expels coolant to a third flow control valve;

a second flow control valve configured to receive coolant from each of the first flow control valve and the engine head cooling jacket, the second flow control valve further configured to occupy a closed position, a first open position, and a second open position, such that the second flow control valve expels coolant to the coolant pump in the first open position and expels coolant to the radiator in the second open position; and the third flow control valve configured to receive coolant from the IEM cooling jacket and further configured to occupy a closed position, a first open position, and a second open position, such that the third flow control valve expels coolant to the heater core in the first open position and expels coolant to each of the heater core and the second flow control valve in the second open position.

16. The method of claim 15 wherein coolant is selectively distributed to the radiator to cool the engine, via the second flow control valve occupying the second open position.

17. The method of claim 15 wherein coolant is selectively distributed to the heater core to warm the passenger compartment via the third flow control valve occupying the first open position; and wherein coolant is selectively distributed back to the coolant pump via the heater core and via the second flow control valve occupying the first open position.

18. The method of claim 16 further comprising the steps of:

selectively distributing coolant from an on/off valve to each of one of a second plurality of flow control valves, an exhaust gas recirculation cooler, an inter-cooler, and a turbocharger cooler, when engine load is increased, wherein the on/off valve receives coolant directly from the coolant pump;

selectively distributing coolant from one of the second plurality of flow control valves to a transmission heat exchanger and an engine oil heat exchanger, when engine load is increased; and distributing coolant from the transmission heat exchanger, the engine oil heat exchanger, the exhaust gas recirculation cooler, the intercooler, and the turbocharger cooler to the radiator.

* * * * *